US011465714B2

(12) United States Patent
Mazzarelli et al.

(10) Patent No.: US 11,465,714 B2
(45) Date of Patent: Oct. 11, 2022

(54) AUTOMATIC POWER BIMINI TOP

(71) Applicant: Commercial Sewing, Inc., Torrington, CT (US)

(72) Inventors: David Mazzarelli, Torrington, CT (US); Sam Mazzarelli, Goshen, CT (US)

(73) Assignee: COMMERCIAL SEWING, INC., Torrington, CT (US)

( * ) Notice: Subject to any disclaimer, the term of this patent is extended or adjusted under 35 U.S.C. 154(b) by 601 days.

(21) Appl. No.: 16/409,414

(22) Filed: May 10, 2019

(65) Prior Publication Data

US 2019/0345721 A1 Nov. 14, 2019

Related U.S. Application Data

(60) Provisional application No. 62/669,749, filed on May 10, 2018.

(51) Int. Cl.

| | |
|---|---|
| ***B63B 17/02*** | (2006.01) |
| ***E04F 10/06*** | (2006.01) |
| ***E04H 15/06*** | (2006.01) |

(52) U.S. Cl.

CPC ..... *B63B 17/02* (2013.01); *E04F 10/0659* (2013.01); *E04H 15/06* (2013.01)

(58) Field of Classification Search

CPC ..... B63B 17/00; B63B 17/02; E04F 10/0659; E04F 10/06; E04H 15/06; E06B 9/00; E06B 9/68

USPC ..... 114/361

See application file for complete search history.

(56) References Cited

U.S. PATENT DOCUMENTS

| | | | | |
|---|---|---|---|---|
| 5,303,667 | A * | 4/1994 | Zirkelbach | B63B 17/02 114/361 |
| 7,950,342 | B2 * | 5/2011 | Russikoff | B63B 17/02 114/361 |
| 8,857,366 | B2 * | 10/2014 | Russikoff | B63B 17/02 114/361 |
| 10,293,889 | B2 * | 5/2019 | Hey | B63B 17/02 |

* cited by examiner

*Primary Examiner* — Lars A Olson
(74) *Attorney, Agent, or Firm* — Cantor Colburn LLP

(57) ABSTRACT

A bimini system for use with a support structure includes a bimini assembly transformable between an open configuration and a closed configuration. The bimini assembly includes a frame and a cover affixed to the frame. A gathering system includes a gathering mechanism associated with the cover. The gathering mechanism is movable to at least one of fold and gather the cover as the bimini assembly transforms from the open configuration to the closed configuration.

25 Claims, 10 Drawing Sheets

AUTOMATIC POWER BIMINI TOP

CROSS REFERENCE TO RELATED APPLICATIONS

This application claims the benefit of U.S. Provisional Application Ser. No. 62/669,749, filed May 10, 2018, which is incorporated herein by reference in its entirety.

BACKGROUND

Stowing a bimini top for a tower structure that is associable with a watercraft can be difficult and inefficient from a standpoint of both a time and storage space. Accordingly, a need exists in the art for a bimini top that can be easily and efficiently stowed.

Watercraft are commonly equipped with adjustable awnings such as, for example, a convertible bimini top. Typically, a bimini top includes a collapsible frame assembly supporting a flexible cover. In many designs, the bimini top can be arranged in multiple positions including a closed position and a fully deployed position. In the closed position, the frame and cover are collapsed and may be held together via a boot that wraps around the collapsed cover. In the fully deployed position, the front support structure is positioned upwardly toward the bow of the boat while the rear support is positioned upwardly toward the stern, thus deploying the cover and providing shelter thereunder.

Deployment of these convertible bimini tops is typically performed manually. There is therefore a need to develop a system for automatically closing and stowing a bimini top.

SUMMARY

According to an embodiment, a bimini system for use with a support structure includes a bimini assembly transformable between an open configuration and a closed configuration. The bimini assembly includes a frame and a cover affixed to the frame. A gathering system includes a gathering mechanism associated with the cover. The gathering mechanism is movable to at least one of fold and gather the cover as the bimini assembly transforms from the open configuration to the closed configuration.

In addition to one or more of the features described above, or as an alternative, in further embodiments the cover has a first end and a second end, and the gathering mechanism further comprises at least one tension strap extending between the first end and the second end.

In addition to one or more of the features described above, or as an alternative, in further embodiments the gathering mechanism is operably coupled to the at least one tension strap and movement of the gathering mechanism applies a force to the at least one tension strap.

In addition to one or more of the features described above, or as an alternative, in further embodiments operation of the gathering mechanism causes the bimini assembly to transform from the open configured to the closed configuration.

In addition to one or more of the features described above, or as an alternative, in further embodiments the gathering mechanism includes at least one roller rotatably mounted to the support structure.

In addition to one or more of the features described above, or as an alternative, in further embodiments the gathering system further comprises at least one passive guiding element associated with the at least one tension strap.

In addition to one or more of the features described above, or as an alternative, in further embodiments the gathering mechanism is mounted to the support structure and is operated by engagement with the bimini assembly as the bimini assembly transforms from the open configuration to the closed configuration.

In addition to one or more of the features described above, or as an alternative, in further embodiments the gathering mechanism includes a lever having a first connector and a second connector arranged at an angle to the first connector, wherein the first connector extends within a path of movement of the bimini assembly.

In addition to one or more of the features described above, or as an alternative, in further embodiments the second connector is arranged in contact with one or more folds of the cover when the bimini assembly is in the closed configuration.

According to another embodiment, a bimini system for use with a support structure includes a bimini assembly transformable between an open configuration and a closed configuration and a boot automatically movable between a first position and a second position to selectively stow the bimini assembly in the closed configuration.

In addition to one or more of the features described above, or as an alternative, in further embodiments in the second position, the boot encloses the bimini assembly.

In addition to one or more of the features described above, or as an alternative, in further embodiments the boot is automatically movable between the first position and the second position via a movement mechanism in response to an input.

In addition to one or more of the features described above, or as an alternative, in further embodiments the bimini assembly further comprises: a frame movably connectable to the support structure and a cover attached to the frame.

In addition to one or more of the features described above, or as an alternative, in further embodiments the bimini assembly further comprises a gathering system operable to fold portions of the cover as the bimini assembly transforms between the open configuration and the closed configuration.

In addition to one or more of the features described above, or as an alternative, in further embodiments the gathering mechanism is operable to transform the bimini assembly between the open configuration and the closed configuration.

In addition to one or more of the features described above, or as an alternative, in further embodiments the frame further comprises: at least one support member rotatably mountable to the support structure and at least one bow pivotally coupled to the at least one support member.

In addition to one or more of the features described above, or as an alternative, in further embodiments the bimini assembly is automatically transformable from the open configuration to the closed configuration via at least one actuation mechanism in response to another input.

In addition to one or more of the features described above, or as an alternative, in further embodiments at least one actuation mechanism includes a first actuation mechanism coupled to the at least one support member.

In addition to one or more of the features described above, or as an alternative, in further embodiments at least one actuation mechanism further includes a second actuation mechanism coupled to the at least one bow.

According to yet another embodiment, a method of stowing a bimini assembly includes transforming a bimini assembly from open configuration to a closed configuration and gathering one or more folds of a cover of the bimini assembly via a gathering mechanism as the bimini assembly transforms from the open configuration to the closed configuration.

In addition to one or more of the features described above, or as an alternative, in further embodiments gathering one or more folds of a cover of the bimini assembly via a gathering mechanism includes applying a force to at least one tension strap of the cover associated with the gathering mechanism.

In addition to one or more of the features described above, or as an alternative, in further embodiments the gathering mechanism is a rotatable component and operating the gathering mechanism includes winding at least one tension strap of the cover about the rotatable component.

In addition to one or more of the features described above, or as an alternative, in further embodiments gathering one or more folds of the cover of the bimini assembly causes the transforming of the bimini assembly from the open configuration to the closed configuration.

In addition to one or more of the features described above, or as an alternative, in further embodiments comprising: providing an input to a movement mechanism and automatically moving a boot from a first position to a second position in response to the input to stow the bimini assembly.

In addition to one or more of the features described above, or as an alternative, in further embodiments automatically moving the boot from the first position to the second position further comprises rotating an actuatable door of the boot about an axis.

In addition to one or more of the features described above, or as an alternative, in further embodiments when the boot is in the second position, the boot encloses the bimini assembly.

In addition to one or more of the features described above, or as an alternative, in further embodiments at least one of the bimini assembly and the boot is connected to a support structure of a watercraft.

DESCRIPTION

Figure 1:
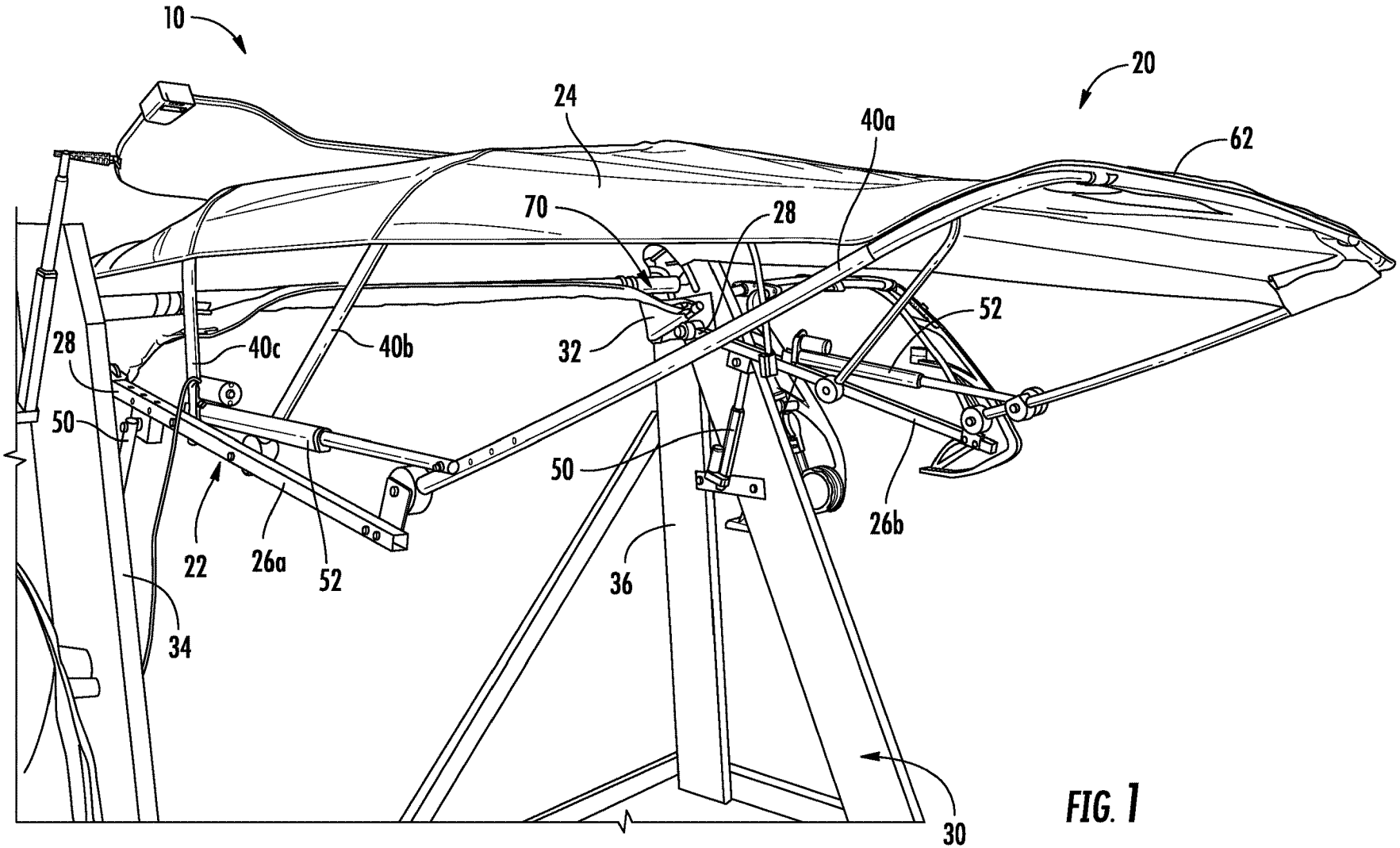
FIG. 1 is a rear perspective view of a bimini frame mounted to a tower structure in an open position according to an embodiment.
Figure 2:
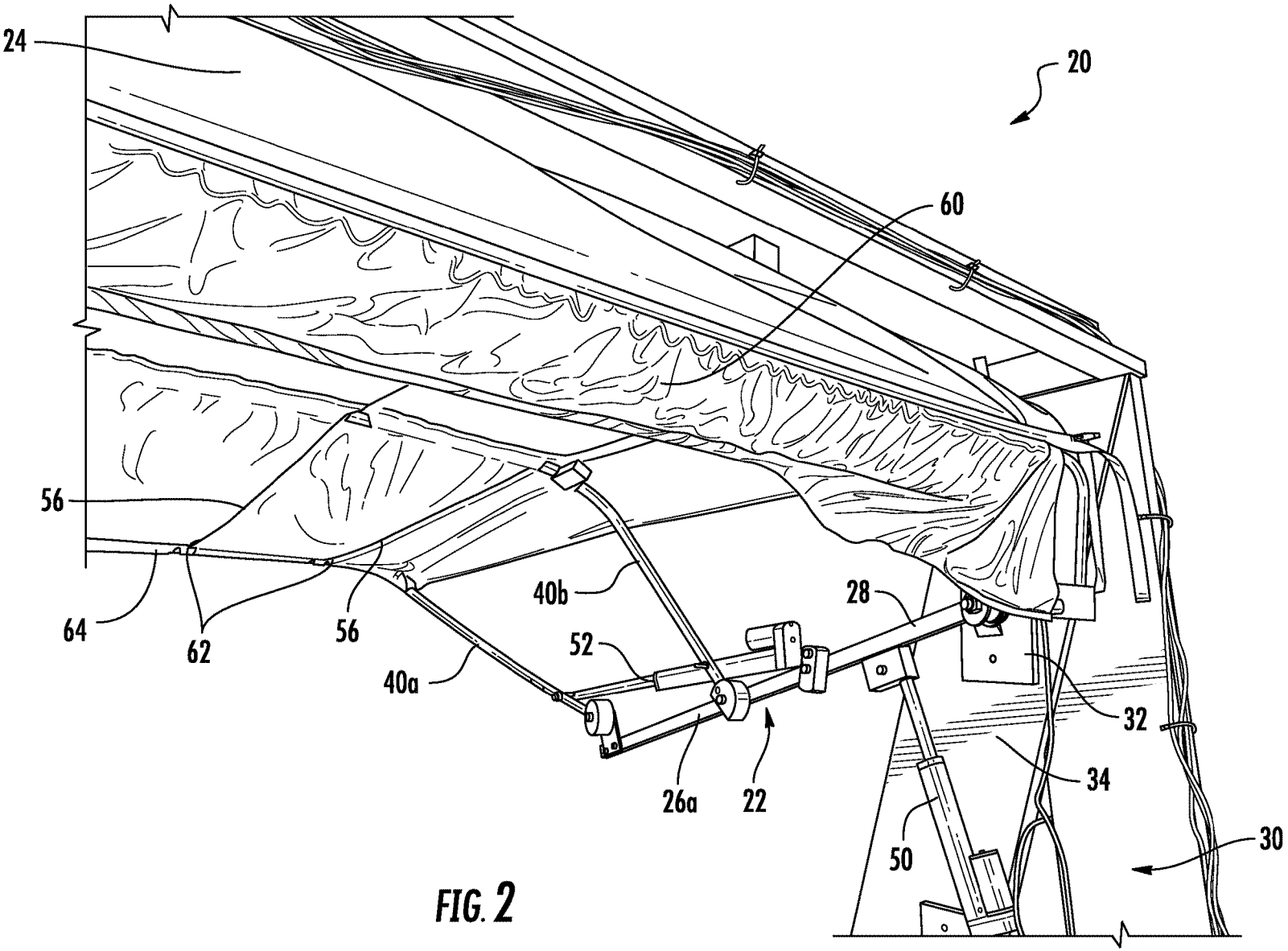
FIG. 2 is a front perspective view of the bimini frame of FIG. 1 in an open position according to an embodiment.

Referring now to the FIGS., an example of a bimini system 10 is shown. The bimini system 10 includes a bimini assembly 20 having a frame 22 that is adapted to support a covering or material 24 thereon is illustrated. As shown, the bimini frame 22 may include several pieces that are formed from a strong, durable, corrosion-resistance material, such as a stainless steel or aluminum alloy for example. The frame 22 includes a substantially identical first support member 26*a* and second support member 26*b* coupled at a first end 28 to a structure 30 of a vehicle, watercraft, or boat, such as a tower or arch for example. The first end 28 may be coupled to the structure 30 directly, or through another component, such as a side plate or bracket 32 for example. In the illustrated, non-limiting embodiment, the first end 28 of the first and second support members 26, 26*b* are rotatably mounted to the tower structure 30, the first end 28 of the first support member 26*a* being disposed adjacent an inner surface of a first side 34 of the tower 30 and the first end 28 of the second support member 26*b* being arranged at an inner surface of a second, opposite side 36 of the tower 30. Although the first and second support members 26*a*, 26*b* are illustrated and described as being mounted to an inner surface of the tower structure 30, in other embodiments, the support members 26*a*, 26*b* may alternatively be mounted to an outer surface of the tower structure 30 or to another portion of the vehicle entirely.

The bimini frame 20 additionally includes one or more bows 40 raised and extending between the first and second support members 26*a*, 26*b*. Each bow 40 typically includes a tubular member formed in a substantially U-shaped configuration having a crossbar extending between opposite side legs which are connected to the support members 26*a*, 26*b*. However, a bow 40 having another configuration is also contemplated herein. In the illustrated, non-limiting embodiment, the frame 22 includes three separate bows arranged at different positions along the length of the first and second support members 26*a*, 26*b*. As shown, the frame 22 includes a rear bow 40*a*, which is coupled to a second end of both the first and second support members 26*a*, 26*b*, an intermediate bow 40*b*, which is coupled to a central portion of the first and second support members 26*a*, 26*b*, and a front bow 40*c* which is also coupled to a central portion of the first and second support members 26*a*, 26*b* at some location between the first end 28 and the intermediate bow 40*b*. However, it should be understood that that bimini frame 22 illustrated and described herein is intended as an example only, and that a bimini frame 22 having any suitable configuration is within the scope of the disclosure. For example, the bimini frame 22 may have any number of bows 40, or alternatively, may have one or more members coupled to the first and/or second support members 26*a*, 26*b* individually.

The bimini assembly 20 additionally may include a permanent or removable cover 24, formed from any suitable material, including but not limited to canvas, plastic, etc. for example, that stretches across the frame 22 and is secured thereto via one or more affixing mechanisms. Examples of such affixing mechanisms include Velcro®, ties, snaps, and other suitable fasteners. In the illustrated, non-limiting embodiment, the cover 24 includes one or more openings or pockets through which each of the bows 40 of the frame 22 extend to couple the cover 24 to the frame 22. Alternatively, the cover 24 may include flaps that are configured to wrap about each of the bows 40 of the frame 22 and secure to another portion of the cover 24.

Figure 4:
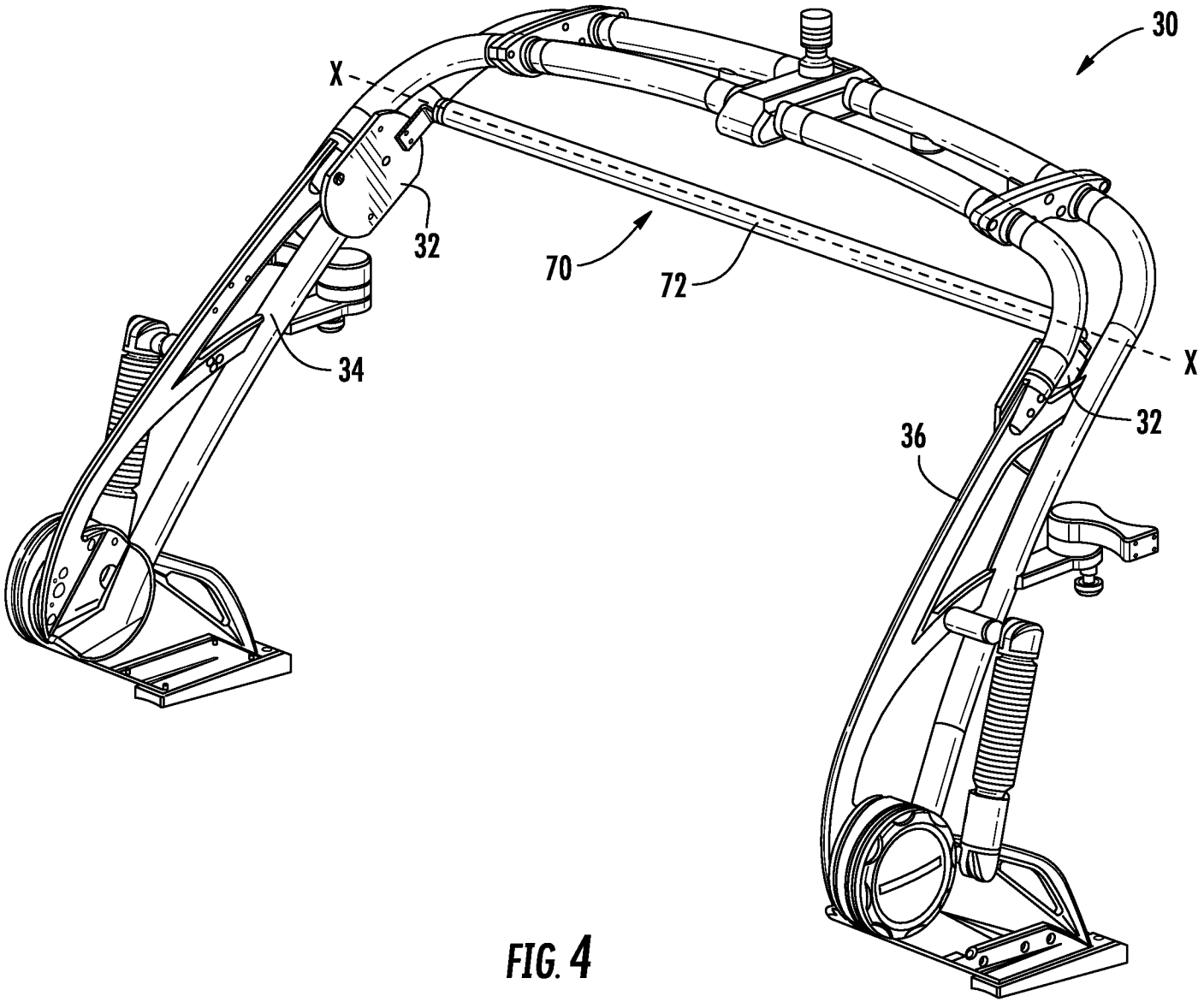
FIG. 4 is a perspective view of a tower structure including a gathering mechanism according to an embodiment.
Figure 5:
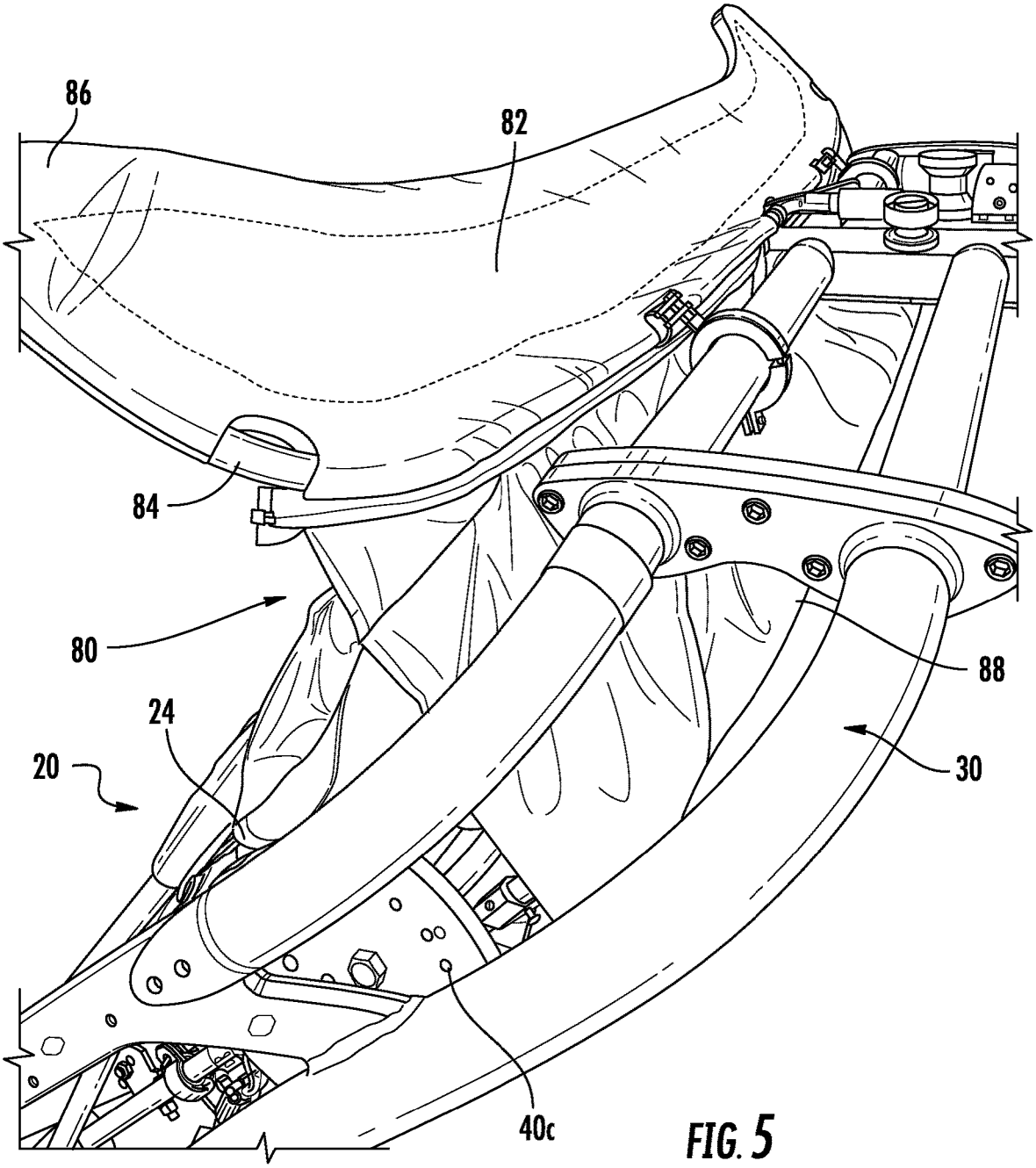
FIG. 5 is a side perspective view of an open boot for selectively stowing a bimini frame in a closed position according to an embodiment.
Figure 6:
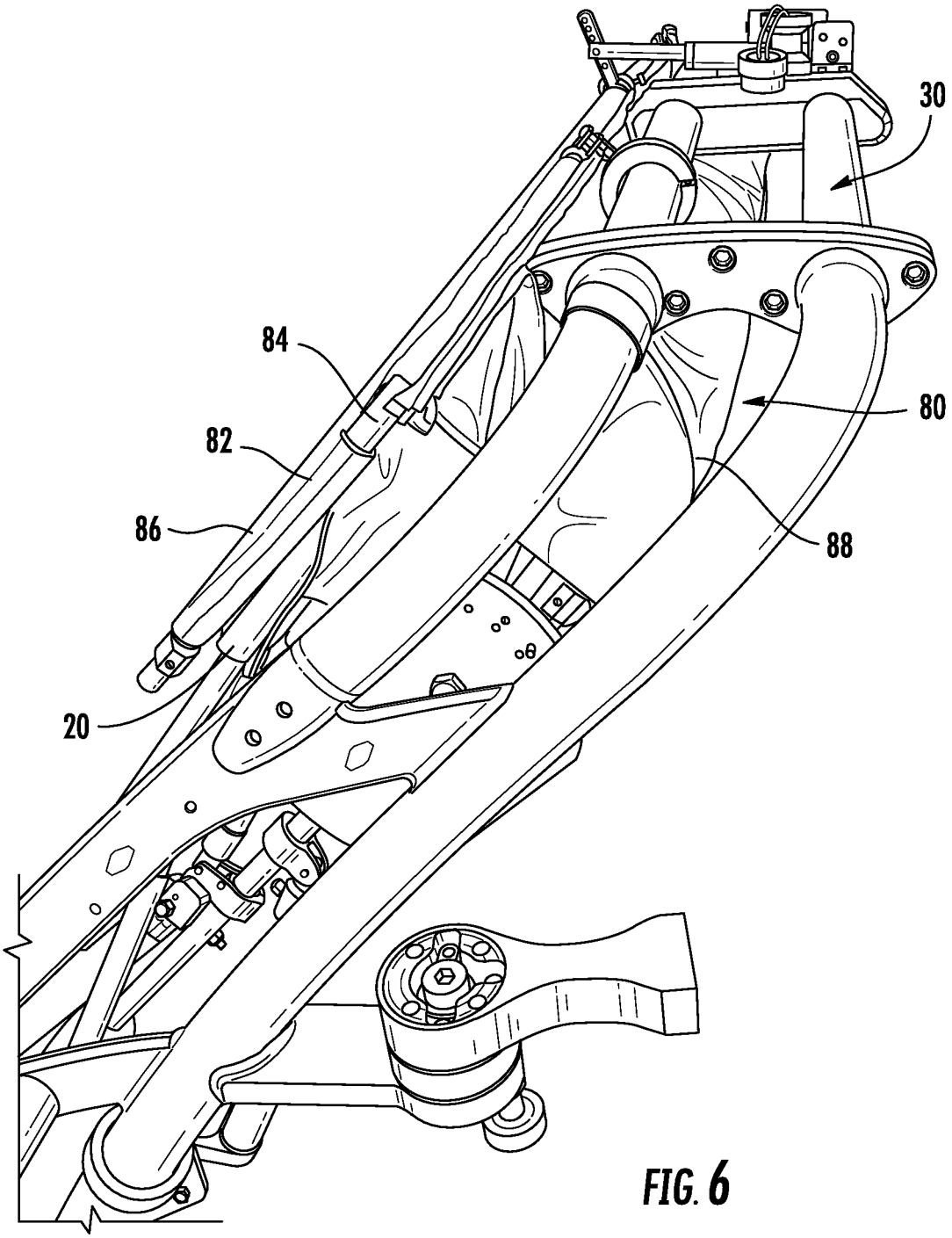
FIG. 6 is a side perspective view of a closed boot for selectively stowing a bimini frame in a closed position according to an embodiment.
Figure 7:
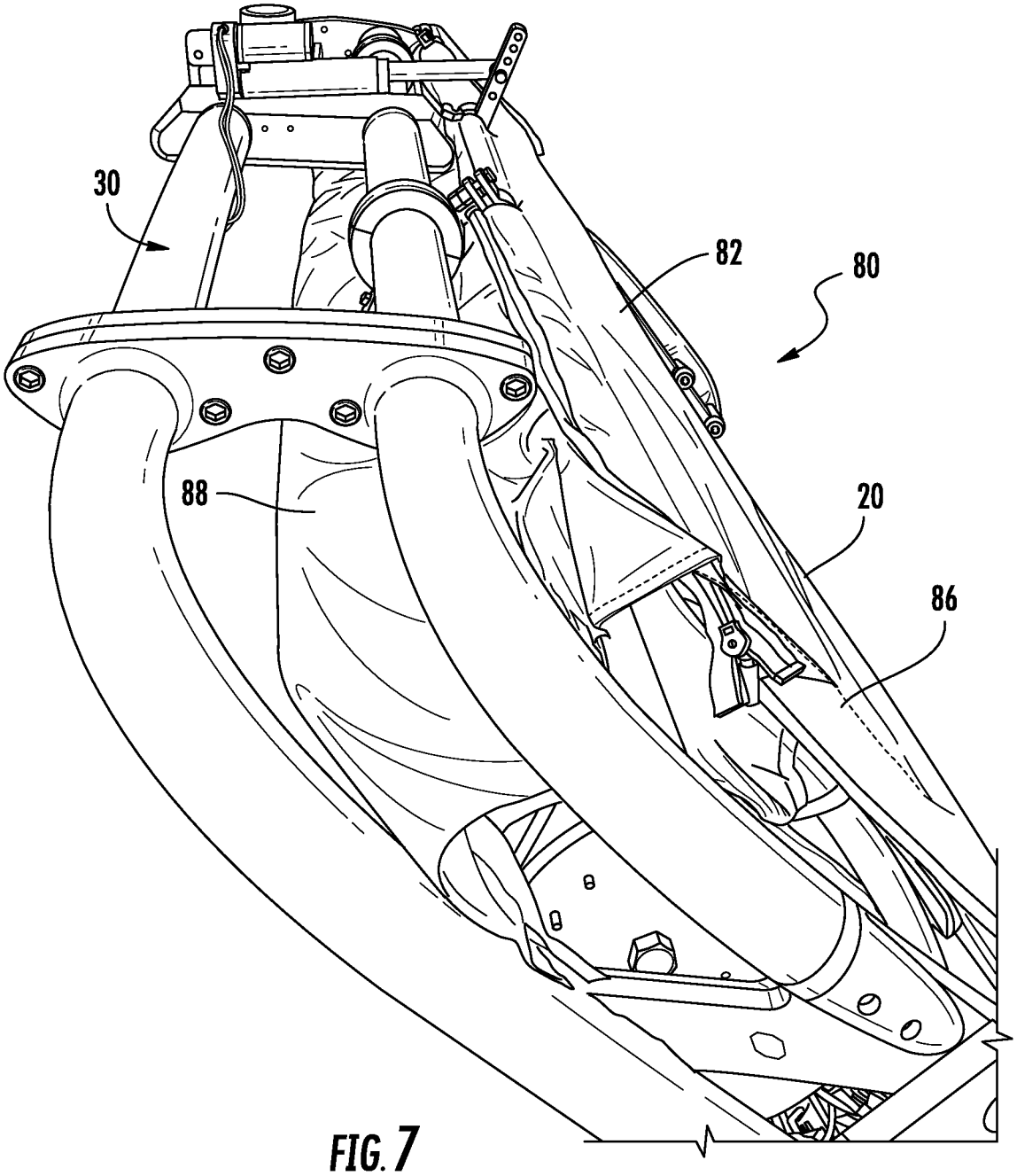
FIG. 7 is another side perspective view of a closed boot for selectively stowing a bimini frame in a closed position according an embodiment.
Figure 8:
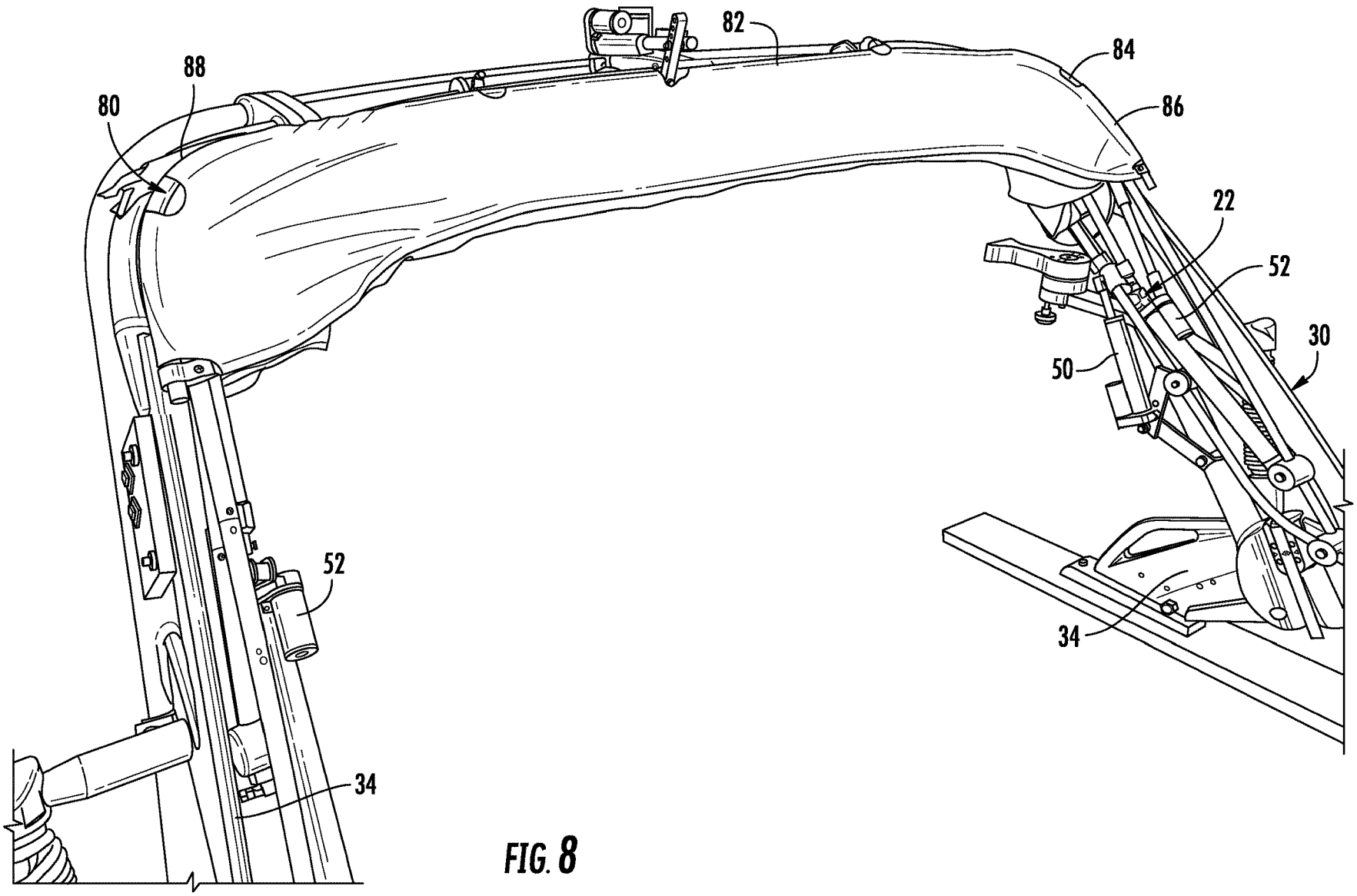
FIG. 8 is a rear perspective view of a closed boot for selectively stowing a bimini frame in a closed position according to an embodiment

As shown, each of the bows 40 is movable between a first, extended position, (FIG. 1 and FIGS. 3 &4) and a second, retracted position (best shown in FIGS. 5 & 6). In the illustrated, non-limiting embodiment, each of the rear bow 40*a*, intermediate bow 40*b*, and front bow 40*c* is pivotally mounted to the first and second support members 26*a*, 26*b*, such as with a hinge for example, such that each bow 40 is movable individually relative to the first and second support members 26*a*, 26*b*. When each of the plurality of bows 40 is in the extended position, the frame 22, and therefore the cover 24 coupled to the frame is arranged in an open configuration. Similarly, when the bows 40 are in a retracted position, the frame 22, and therefore the cover 24 couple to the frame 22, is in one of a closed configuration (FIG. 6) and/or a stowed configuration (FIG. 7). As shown in the FIGS., in the closed and stowed configurations, the plurality of bows 40 and the first and second support member 26*a*, 26*b* are oriented substantially parallel to the sides 34, 36 of the tower structure 30.

Transformation of the bimini assembly 20 between an open configuration and a closed and/or stowed configuration may be performed automatically, such as in response to operation of a switch or button for example. In the illustrated, non-limiting embodiment, the bimini assembly 20 includes one or more actuation systems for automatically transforming the bimini assembly 20 between the open configuration, the closed configuration, and the stowed configuration. As shown, the actuation system includes at least one first actuator 50 is mounted to a portion of the tower structure 30 and is operably coupled to a portion of one of the first support member 26*a* and the second support member 26*b*, such as between the first end 28 and the front bow 40*c*. Although two first actuators 50 are shown in the FIGS., one associated with each of the first support member 26*a* and the second support member 26*b*, embodiments having only a single first actuator 50 for moving both the first and second support member 26*a*, 26*b* are also within the scope of the disclosure.

The at least one first actuator 50 is operable to movie the first and/or second support member 26*a*, 26*b* between a first position, in which the support member 26*a*, 26*b* is generally parallel to the sides 34, 36 of the tower structure 30, and a second position, in which the support members 26*a*, 26*b* extend at an angle relative to the side of the tower structure 30, such as within 10 degrees of horizontal for example. In embodiments including multiple first actuators 50, operation of the plurality of first actuators 50 may be synchronized to enhance the smoothness of the transformation of the first and second support members 26*a*, 26*b* between the first and second positions.

In an embodiment, a second actuator 52 is mounted to one of the first support member 26*a* and the second support member 26*b* and is operably coupled to the rear bow 40*a* to move the rear bow 40*a* between the retracted and extended positions. One second actuator 52 may be sufficient to move the rear bow 40*a*. However, in other embodiments, as shown, the system 20 may include two second actuators 52, mounted to the first and second support member 26*a*, 26*b* respectively, and coupled to opposing sides of the rear bow 40*a*. In embodiments including multiple second actuators 52, operation of the plurality of second actuators 52 may be synchronized to enhance the smoothness of the transformation between the extended and retracted positions. Further, operation of one or more the second actuators 52 may, but need not be limited to when the first and second support members 26*a*, 26*b* are in the second position, or transforming between the first and second positions. The first and second actuators 50, 52 are shown as hydraulically or pneumatically powered linear actuators; however, any suitable actuation mechanism is considered within the scope of the disclosure. Further, although first and second actuators 50, 52 are illustrated and described for transforming the frame 22 between an open and closed or stowed configuration, it should be understood that other configurations of the actuation system may be used based on the configuration of the bimini frame 22.

Figure 3:
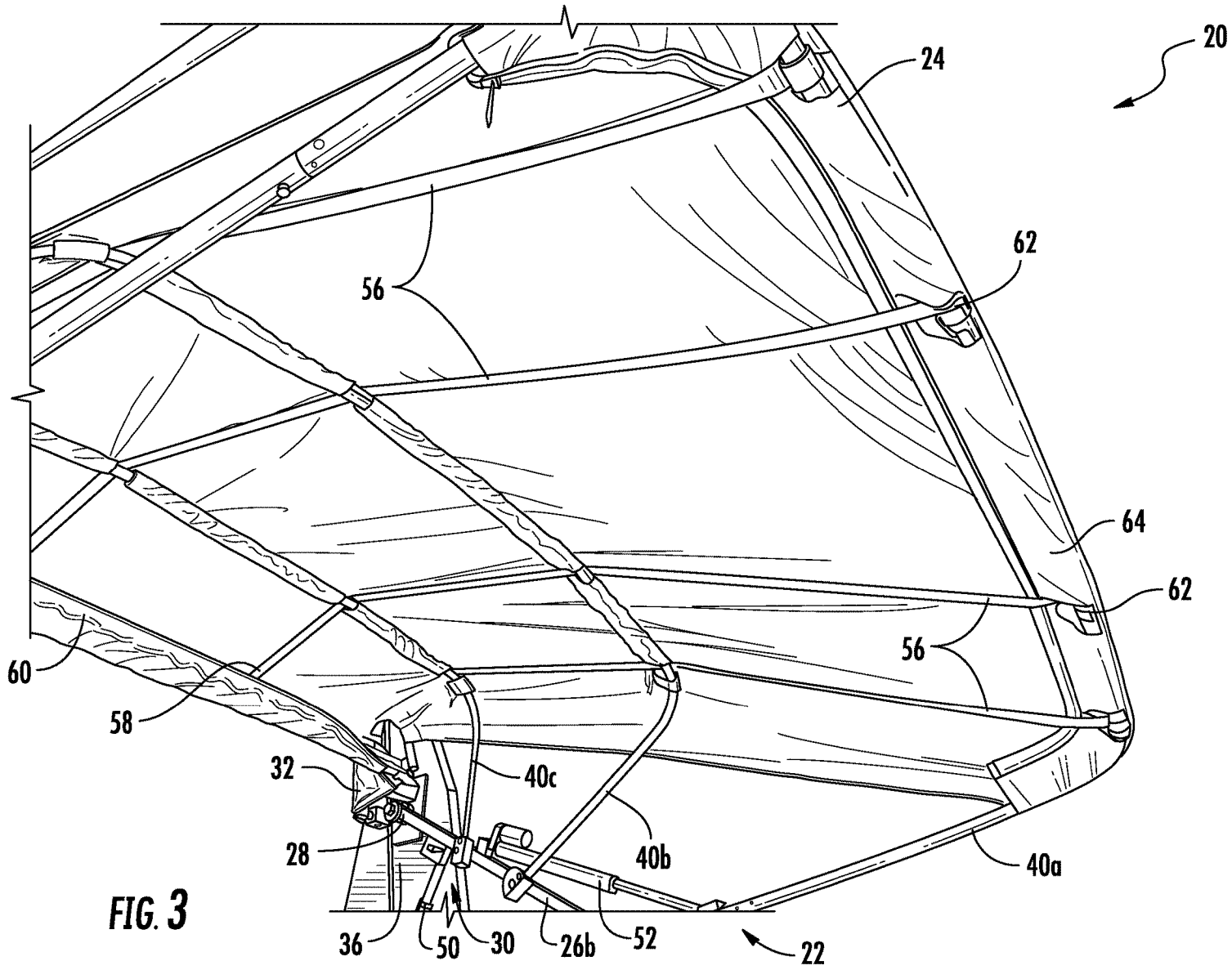
FIG. 3 is a side perspective view of the bimini frame of FIG. 1 in an open position according to an embodiment.

The bimini system 10 may additionally include a gathering system configured to automatically gather the material of the cover 24 as the bimini assembly 20 transforms from the open configuration to the closed configuration. In an embodiment, best shown in FIG. 3, the gathering system includes one or more tension straps 56 attached to the cover 24. As shown, a first end 58 of each tension strap 56 is positioned near a first end 60 of the cover 24 and a second, opposite end 62 of each tension strap 56 is coupled to a second end 64 of the cover 24. The tension straps 56 may be positioned between one or more of the bows 40 and the adjacent cover material 24, as shown in FIG. 3, to prevent the straps 56 from hanging loosely downwardly from the surface of the cover 24. As used herein, the term "strap" is intended to include other suitable materials, including but not limited to rope, webbing, cable, cord, elastic, or chain, extending between the first and second opposite ends 60, 64 of the cover 24.

As the bimini assembly 20 is transformed between the open configuration and the closed configuration, a force is applied to the one or more tension straps 56. In an embodiment, a length of each tension strap 56 is less than the length of the cover 24 such that application of a force to the tension strap 56 facilitates rotation of each of the bows 40 of the frame 22 to rotate toward a retracted position. Further, as the bows 40 rotate, the straps facilitate folding or gathering of the material of the cover 24 disposed between adjacent bows 40. It should be understood that any number of folds, puckering, or gathered portions of material may be formed as the bimini frame transforms from the open position to the closed position. The gathering system may be suitable to gather all or at least a portion of these folds.

In an embodiment, best shown in FIG. 4, the gathering system of the bimini assembly 20 additionally includes a gathering mechanism 70 operable to apply a force to the tension straps 56 and to wind the tension straps 56 about the circumference of the gathering mechanism 70. In the illustrated, non-limiting embodiment of FIG. 4, the gathering mechanism 70 includes a roller 72 extending between opposing sides 34, 36 of the tower structure 30. The roller 72 is configured to rotate about a longitudinal axis X thereof. In an embodiment, rotation of the roller 72 is driven by a motor (not shown); however, any suitable mechanism for automatically driving rotation of the roller 72 about its axis X, or alternatively, for operating the gathering mechanism 70, is within the scope of the disclosure. For example, in an embodiment, the roller 72 may have a spring tension, such that the bias of the spring (not shown) is configured to automatically apply tension to the tension straps 56 of the cover 24. The first end 58 of the tension straps 56 and/or the cover 24 is associated with or affixed to the gathering mechanism 70.

Figure 9:
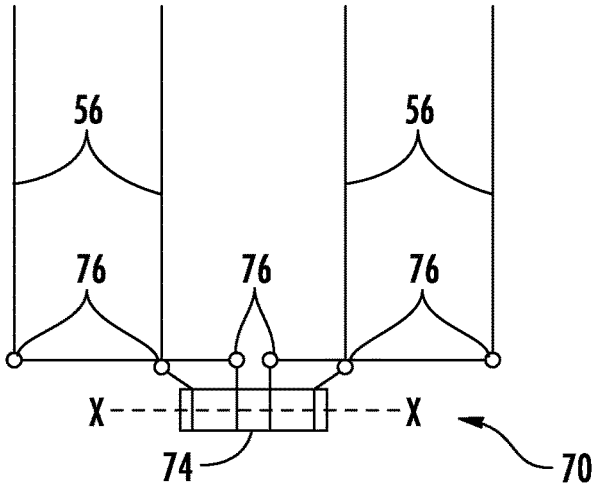
FIG. 9 is a schematic diagram of a gathering mechanism according to an embodiment.

Although the roller of FIG. 4 extends substantially between the first side 34 and the second side 36 of the tower structure 30, in another embodiment, best shown in FIG. 9, the gathering mechanism 70 includes a short roller 74 having an axial length shorter than the distance between the first side 34 and the second side 36 of the tower structure 30. Although the roller 74 is illustrated as being located generally centrally relative to the tower structure 30, embodiments where the roller 74 is skewed towards either the first side 34 or the second side 36 of the tower structure 30 are also contemplated herein. The gathering system may additionally include one or more passive guiding elements, such as pulleys or spools 76 that are rotationally engaged with the one or more tension straps 56. The pulleys 76 are positioned to direct each of the tension straps 56 toward a corresponding portion of the roller 74 to prevent tangling during the gathering process. As the gathering mechanism applies a force to the tension straps 56, a result, each of the pulleys is driven about a respective axis by the movement of the tension straps 56.

Figure 10:
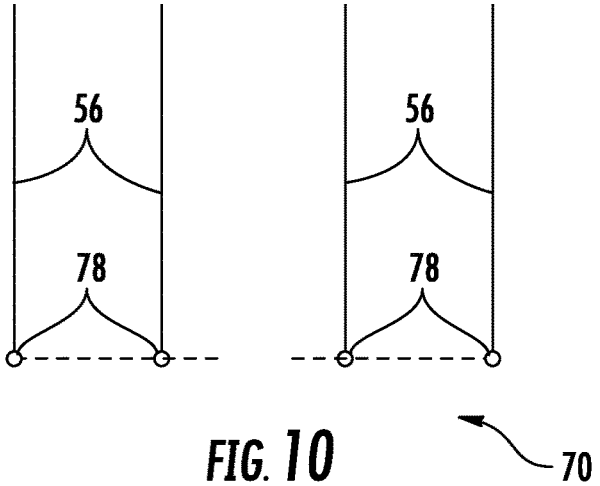
FIG. 10 is a schematic diagram of a gathering mechanism according to an embodiment.
Figure 11:
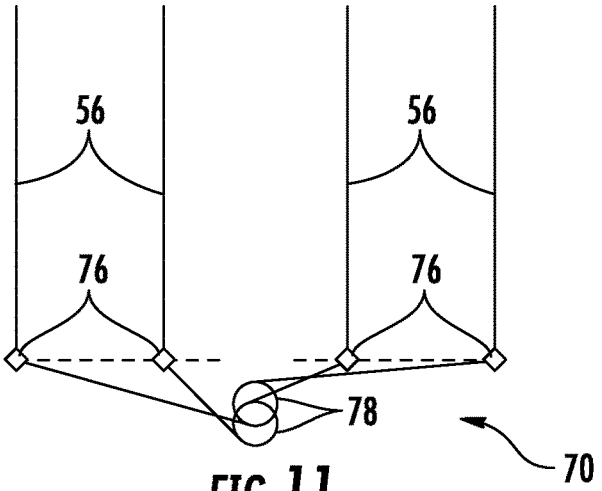
FIG. 11 is a schematic diagram of a gathering mechanism according to an embodiment.

With reference now to FIG. 10, in another embodiment, the gathering mechanism 70 includes a plurality of individual rollers or spools 78, each of which is generally aligned with a corresponding tension strap 56. Alternatively, the plurality of individual rollers or spools may be oriented in a stacked relationship. The spools 78 may be stacked vertically, as shown in FIG. 11, or may be stacked horizontally. In either configuration, the spools 78 may be coaxially arranged, or may be positioned with a limited axial offset. In embodiments where the spools 78 are axially offset, adjacent spools 78 are positioned to at least partially overlap one another. Further, in embodiments where the spools 78 are stacked, the gathering mechanism 70 may additionally include a plurality of pulleys or rollers 76 that are rotationally engaged with the one or more tension straps 56 to direct each of the tension straps 56 toward a corresponding spool 78. The various configurations of the gathering mechanisms 70 illustrated and described herein are intended as an example only. It should be understood that any suitable mechanism for applying tension to the one tension straps 56 affixed to the cover 24 are within the scope of the disclosure.

When transformation of the bimini assembly 20 between an open configuration and a closed configuration is initiated, the gathering mechanism 70 is operated, such as by driving the roller about its axis X for example, or by driving each of the individual spools about a respective. In an embodiment, operation of the gathering mechanism 70 may be used to initiate transformation of the bimini assembly between an open configuration and a closed configuration. Alternatively, operation of one or more of the actuation mechanisms may initiate transformation of the bimini assembly 20. As the gathering mechanism 70 operates, a force is applied to each of the plurality of tension straps 56, causing the bows 40*a*, 40*b*, 40*c* to pivot about their respective axes from the extended position toward the retracted position. In some embodiments, this force applied to the rear bow 40*a* causes the movable portion of the at least one second actuator 52 associated therewith to retract. At substantially the same time, the at least one first actuator 50 gradually lowers the distal end of the first and second members 26*a*, 26*b* into the first position. The first support member 26*a* and the second support member 26*b* remain generally parallel to one another throughout the transformation of the frame assembly 22 between the open and closed configurations.

As the bows 40*a*, 40*b*, 40*c* pivot, the material of the cover 24 is folded or gathered by the continuous tension applied to the cover 24 via the engagement between the gathering mechanism 70 and the tension straps 56. Because the first and second support member 26*a*, 26*b* are rotated relative to the tower structure 30 simultaneously with the rotation of the bows 40*a*, 40*b*, 40*c*, the plurality of bows 40*a*, 40*b*, 40*c* may be generally vertically aligned despite their difference in height once reaching the retracted position. Although the tension straps 56 are illustrated and described herein as being wound about a gathering mechanism, in other embodiments, another suitable gathering mechanism, such as one or more springs or weights located at or in the tower structure 30 or even gravity for example, may be used to effectively gather the material of the cover 24.

Figure 12A:
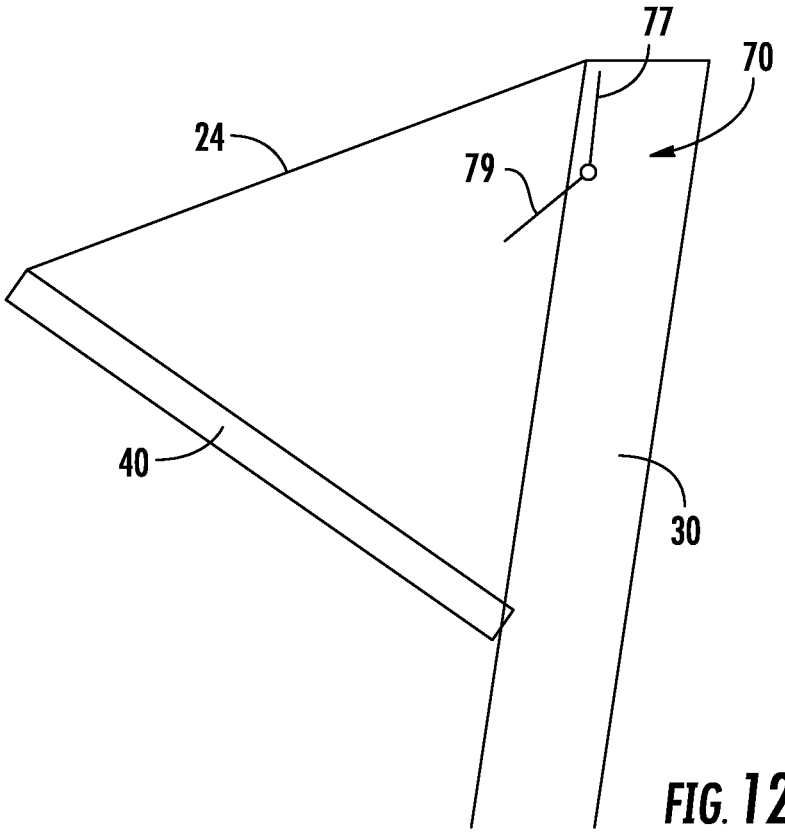
FIGS. 12A and 12B are side views of a tower structure including another gathering mechanism according to an embodiment.
Figure 12B:
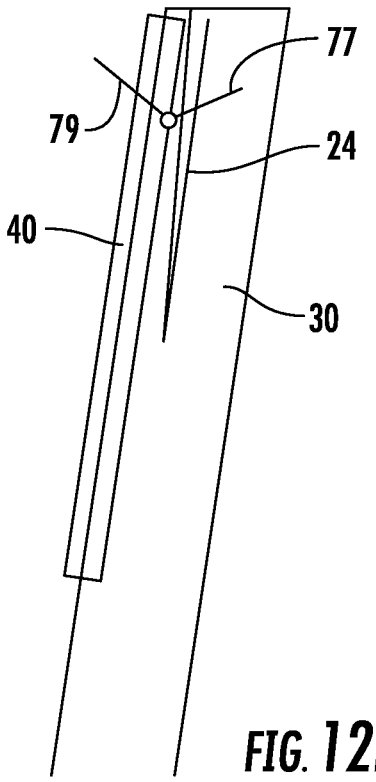

In an embodiment, best shown in FIGS. 12A-12B, the gathering mechanism 70 includes a lever mounted to a portion of the tower structure 30, such as at least one side thereof for example. As shown, the lever includes a first connector 77 and a second connector 79 configured to rotate or pivot about an axis. When the bimini assembly 20 is in an open configuration (FIG. 12A), the first connector 77 may extend generally vertically and within the path of movement of the bimini assembly 20. During transformation to the closed configuration, the front bow 40*c* rotates about a pivot point toward the tower structure 30, for example driven by one of the actuators. As the front bow 40*c* moves, it engages the first connector 77 of the gathering mechanism 70. The contact between the front bow 40*c* and the first connector 77 causes the gathering mechanism 70 to rotate about its axis. As the intermediate bow 40*b* and the rear bow 40*a* pivot toward the tower structure 30, the second connector 79 of the gathering mechanism 70 extends behind and applies a rotational force to the rear bow 40*a* (FIG. 12B). As a result of the engagement between the second connector 79 and the rear bow 40*a*, the bimini assembly 20 is gathered between the tower structure 30 and the gathering mechanism 70.

With reference to FIG. 6, the bimini system 10 additionally includes a boot 80 mounted to the tower structure 30. In the illustrated, non-limiting embodiment, a portion of the boot 80, such as an actuated door 82 for example, is movable between a first, open position, where the actuated door 82 is arranged at an angle to the tower structure 30, and a second, closed position, where the door is oriented generally parallel to the sides 34, 36 tower structure 30. The actuated door 82 may further be transformable to a third position when the bimini frame 22 is deployed, best shown in FIG. 1. In such embodiment, the actuated door 82 is positioned generally adjacent the cover 24 of the bimini assembly 20. The angle between the tower structure 30 and the actuated door is greater when the actuated door 82 is in the first, open position rather than the third position, to allow the bows 40 of the bimini frame 22 to move freely without interference by the door 82.

In the illustrated, non-limiting embodiment, the actuated door 82 of the boot includes a frame 84 having a fabric or flexible material 86 affixed thereto. However, in other embodiments, the boot 80 and/or actuated door 82 may be formed from at least one of a composite or metal material. In an embodiment, as shown, a portion 88 of the material extends over the top of the bimini assembly 20 and is affixed to a portion of the tower structure 30 or to a portion of the bimini assembly 20. In the illustrated non-limiting embodiment, the actuatable door 82 of the boot 80 is rotatable about an axis between the first position (FIG. 5) and the second position (FIGS. 6 and 7) to selectively encase and protect the collapsed or closed bimini assembly 20 including the frame 22 and gathered material of the cover 24 within the boot 80. When the bimini assembly 20 is in the closed configuration and the actuatable door 82 of the boot 80 is in the closed position, the bimini assembly 20 is considered "stowed." In the stowed configuration, the bimini assembly 20 is not only protected from the elements, including damage by wildlife, but is also confined in a manner suitable for trailering of the vehicle including the tower structure 30.

Once the bimini assembly 20 is arranged in a closed configuration, the actuatable door 82 of the boot 80 may be automatically positioned in overlapping arrangement with the rear bow 40*a* to enclose the gathered cover 24 of the assembly 20 within the boot 80. The actuatable door 82 of the boot 80 may be driven by any suitable movement mechanism (not shown), including but not limited to a motor or an actuator for example. The same switch or button used to retract the bimini assembly 20, or alternatively, a different switch or button, may be configured to communicate with the movement mechanism to initiate automatic movement of the boot 80 to selectively stow the bimini assembly 20. Further operation of the button or switch may cause the boot 80 and the bimini assembly 20 to move in reverse order, first opening the boot 80 and the transforming the bimini assembly 20 to an extended position.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A bimini system for use with a support structure comprising:

a bimini assembly transformable between an open configuration and a closed configuration, the bimini assembly including a frame and a cover affixed to the frame; and a gathering system including a gathering mechanism associated with the cover, wherein the gathering mechanism is mounted to the support structure and is movable to at least one of fold and gather the cover as the bimini assembly transforms from the open configuration to the closed configuration.

2. The bimini system of claim 1, wherein the cover has a first end and a second end, and the gathering mechanism further comprises at least one tension strap extending between the first end and the second end.

3. The bimini system of claim 2, wherein the gathering mechanism is operably coupled to the at least one tension strap and movement of the gathering mechanism applies a force to the at least one tension strap.

4. The bimini system of claim 3, wherein operation of the gathering mechanism causes the bimini assembly to transform from the open configured to the closed configuration.

5. The bimini system of claim 3, wherein the gathering mechanism includes at least one roller.

6. The bimini system of claim 5, wherein the gathering system further comprises at least one passive guiding element associated with the at least one tension strap.

7. The bimini system of claim 1, wherein the gathering mechanism is mounted to the support structure and is operated by engagement with the bimini assembly as the bimini assembly transforms from the open configuration to the closed configuration.

8. The bimini system of claim 7, wherein the gathering mechanism includes a lever having a first connector and a second connector arranged at an angle to the first connector, wherein the first connector extends within a path of movement of the bimini assembly.

9. The bimini system of claim 8, wherein the second connector is arranged in contact with one or more folds of the cover when the bimini assembly is in the closed configuration.

10. A bimini system for use with a support structure comprising:

a bimini assembly transformable between an open configuration and a closed configuration; and a boot mounted to the support structure, a portion of the bimini assembly being receivable within an interior of the boot when the bimini assembly is in the closed configuration; and a door movable relative to the boot between a first position and a second position to close the interior and selectively stow the bimini assembly.

11. The bimini system of claim 10, wherein in the second position, the boot encloses the bimini assembly.

12. The bimini system of claim 10, wherein the boot is automatically movable between the first position and the second position via a movement mechanism in response to an input.

13. The bimini system of claim 12, wherein the bimini assembly further comprises:

a frame movably connectable to the support structure; and a cover attached to the frame.

14. The bimini system of claim 13, wherein the bimini assembly further comprises a gathering system operable to fold portions of the cover as the bimini assembly transforms between the open configuration and the closed configuration.

15. The bimini system of claim 14, wherein the gathering mechanism is operable to transform the bimini assembly between the open configuration and the closed configuration.

16. The bimini system of claim 13, wherein the frame further comprises:

at least one support member rotatably mountable to the support structure; and at least one bow pivotally coupled to the at least one support member.

17. The bimini system of claim 16, wherein the bimini assembly is automatically transformable from the open configuration to the closed configuration via at least one actuation mechanism in response to another input.

18. The bimini system of claim 17, wherein at least one actuation mechanism includes a first actuation mechanism coupled to the at least one support member.

19. The bimini system of claim 18, wherein at least one actuation mechanism further includes a second actuation mechanism coupled to the at least one bow.

20. A method of stowing a bimini assembly comprising:

transforming a bimini assembly from open configuration to a closed configuration; and automatically rotating a gathering mechanism via a motor;

gathering one or more folds of a cover of the bimini assembly via the gathering mechanism as the bimini assembly transforms from the open configuration to the closed configuration;

providing an input to a movement mechanism; and automatically rotating a door of a boot about an axis from a first position to a second position in response to the input to stow the bimini assembly.

21. The method of claim 20, wherein gathering one or more folds of a cover of the bimini assembly via a gathering mechanism includes applying a force to at least one tension strap of the cover associated with the gathering mechanism.

22. The method of claim 21, wherein operating the gathering mechanism includes winding at least one tension strap of the cover about the rotatable component.

23. The method of claim 20, wherein gathering one or more folds of the cover of the bimini assembly causes the transforming of the bimini assembly from the open configuration to the closed configuration.

24. The method of claim 20, wherein when the boot is in the second position, the boot encloses the bimini assembly.

25. The method of claim 20, wherein at least one of the bimini assembly and the boot is connected to a support structure of a watercraft.

* * * * *